US011109148B2

(12) United States Patent
Desrosiers et al.

(10) Patent No.: US 11,109,148 B2
(45) Date of Patent: Aug. 31, 2021

(54) ISOPHASIC WAVEGUIDE FOR A LOUDSPEAKER

(71) Applicant: EAW NORTH AMERICA, INC, Whitinsville, MA (US)

(72) Inventors: Steven Desrosiers, Woonsocket, RI (US); Geoffrey Peter McKinnon, Providence, RI (US); Zhao Zuo, Worcester, MA (US)

(73) Assignee: EAW NORTH AMERICA, INC., Whitinsville, MA (US)

( * ) Notice: Subject to any disclaimer, the term of this patent is extended or adjusted under 35 U.S.C. 154(b) by 0 days.

(21) Appl. No.: 16/262,428

(22) Filed: Jan. 30, 2019

(65) Prior Publication Data

US 2020/0245061 A1 Jul. 30, 2020

(51) Int. Cl.
*H04R 1/28* (2006.01)
*H04R 1/30* (2006.01)

(52) U.S. Cl.
CPC ..... *H04R 1/2857* (2013.01); *H04R 1/30* (2013.01)

(58) Field of Classification Search
CPC ..... H04R 1/2857; H04R 1/30
See application file for complete search history.

(56) References Cited

U.S. PATENT DOCUMENTS

| | | | | |
|---|---|---|---|---|
| 8,887,862 | B2 * | 11/2014 | Hughes, II | H04R 1/30 181/175 |
| 2012/0033842 | A1 | 2/2012 | Donarski | |
| 2014/0270308 | A1 | 9/2014 | Donarski | |
| 2016/0212523 | A1 * | 7/2016 | Spillmann | H04R 1/2803 |
| 2018/0063636 | A1 * | 3/2018 | Spillmann | H04R 1/323 |

* cited by examiner

*Primary Examiner* — Brian Ensey
(74) *Attorney, Agent, or Firm* — Pearne & Gordon LLP

(57) ABSTRACT

A waveguide (1) comprising a shell (11, 12) having an inlet opening (110, 120) intended to receive acoustic energy and an outlet opening (111, 121) for emitting acoustic energy; and a phase plug (13, 14) located into the shell (11, 12) so as to define therebetween a pathway (W) for the acoustic energy from the inlet opening (110, 120) to the outlet opening (111, 121). The acoustic pathway (W) has a longitudinal extension direction (D) between the openings (110, 120, 111, 121) and the directions of all longitudinal splines (S1, S2, S3, S4, S5, S6) of the pathway (W) are perpendicular to the inlet opening (110, 120) at the inlet opening (110, 120) on one ideal longitudinal surface.

27 Claims, 8 Drawing Sheets

ISOPHASIC WAVEGUIDE FOR A LOUDSPEAKER

The present invention relates to loudspeakers and more in particular to an improved waveguide for a loudspeaker.

Currently, most of the large loudspeaker systems for professional audio applications are designed with a "line-array" configuration.

In detail, this kind of system includes a plurality of audio modules intended to reproduce a full range of frequencies, which are vertically stacked together, very close to each other, so as to define a single extended source of all applicable frequencies.

Each module is designed to produce a wavefront, which is as smooth as possible, for the full range of frequencies of interest.

Basically, each module is devised to produce a response which is isophasic or a very good approximation thereof.

The modules are provided with respective waveguides, which are intended to convert an incoming round cross-sectional sound wavefront into a flat, tall and thin rectangular cross-sectional wavefront.

The waveguides are made of two main components: a shell having an internal surface, which is such shaped so as to provide the above-mentioned change in the cross-section of the wavefront, and an acoustic phase plug, located within the shell, which in cooperation with said internal shape provides the wave with the required phase coherence.

Currently, most of the waveguides define a plurality of pathways for acoustic energy from the entrance to the exit of the waveguide, thereby producing a simulated isophasic response.

Waveguides exist that have single path designs, which however are characterized by geometries unable to avoid the generation of acoustic reflections and/or turbulence of the sound wave into their single paths and/or comb filtering external to the waveguide, thereby producing sub-optimal responses It is an objective of the present invention to provide a waveguide for a loudspeaker able to produce an actual isophasic response and able at the same time to minimize or even nullify reflections and turbulences.

This objective is achieved by the waveguide realized in accordance with claim 1.

Additional features and advantages of the present invention will be more apparent from the illustrative, and thus non-limiting, description, of a preferred, but not exclusive embodiment of the invention, as illustrated in the appended drawings in which.

Figure 1:
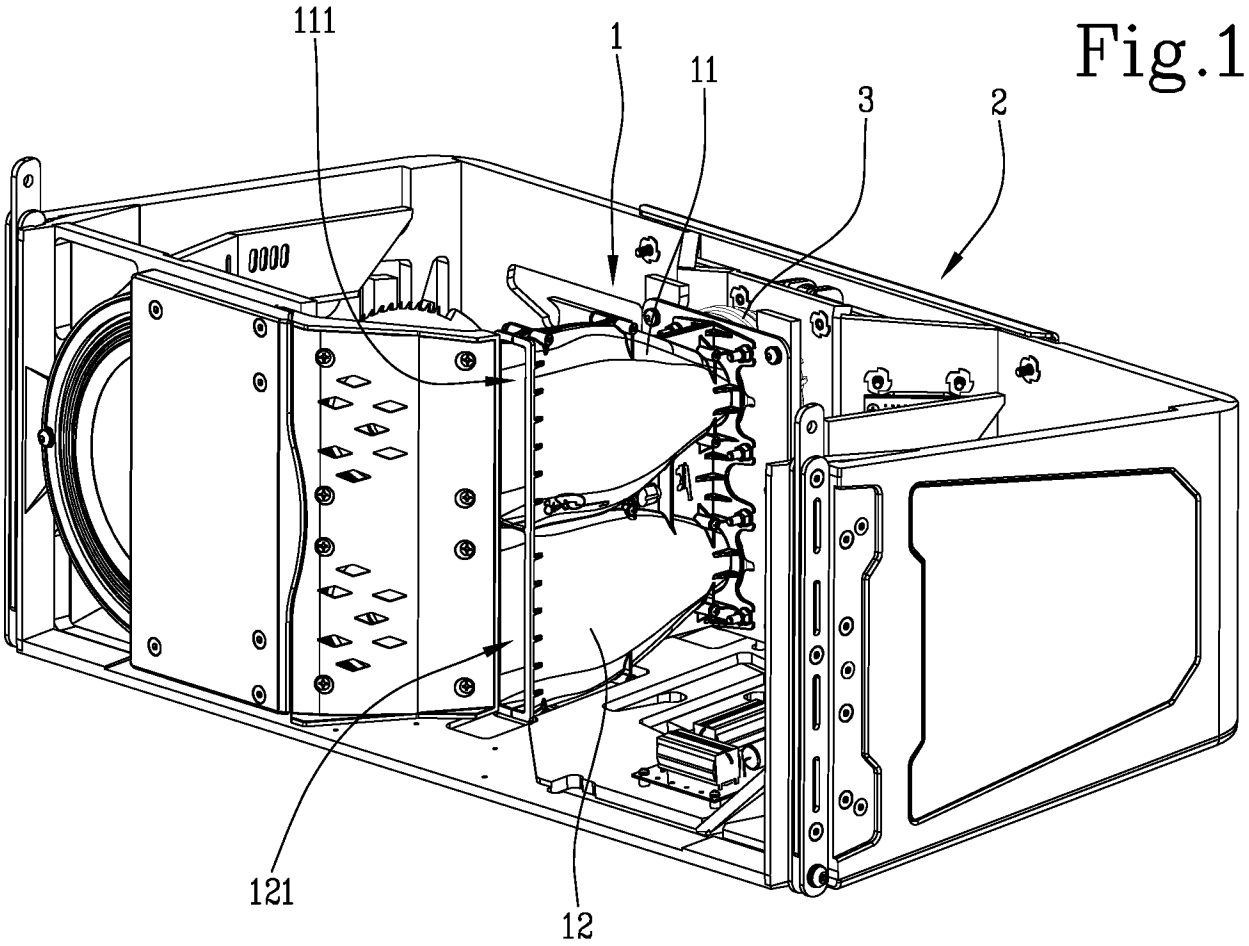
FIG. 1 is a perspective view of an open loudspeaker including the waveguide assembly of the invention.

With reference to the aforementioned figures, 1 indicates a waveguide intended to be used in a loudspeaker 2, especially but not necessarily in a "line-array" loudspeaker. The waveguide 1 of the invention includes a shell assembly which comprises at least one shell 11, 12, that is a hollow housing, having an inlet opening 110, 120 (shown in FIGS. 2, 10 and 11) intended to receive the acoustic energy produced by a compression driver 3 and an outlet opening 111, 121 (shown in FIGS. 1, 10 and 11) for emitting the response towards the outside.

Note that the shell 11, 12 (or each shell, if there is more than one, which is a case discussed later on in the description) can be used in cooperation with a horn, in order to further control the usable-frequency spectrum waveform propagation.

Preferably, the inlet opening 110, 120 is circular and the outlet opening 111, 121 is rectangular; however, other shapes are possible, and for example the inlet opening 110, 120 can be rectangular and the outlet opening 111, 121 can be oval.

If the outlet opening 111, 121 is rectangular, it can be between 25 and 26 mm in width and more preferably about 25.4 mm.

If the inlet opening 110, 120 is circular, it can be shaped so as to be coupled with a 35.6 mm exit diameter compression driver 3; however, the waveguide 1 can also be designed to fit 50 mm, 25 mm or 19 mm diameter drivers.

Figure 10:
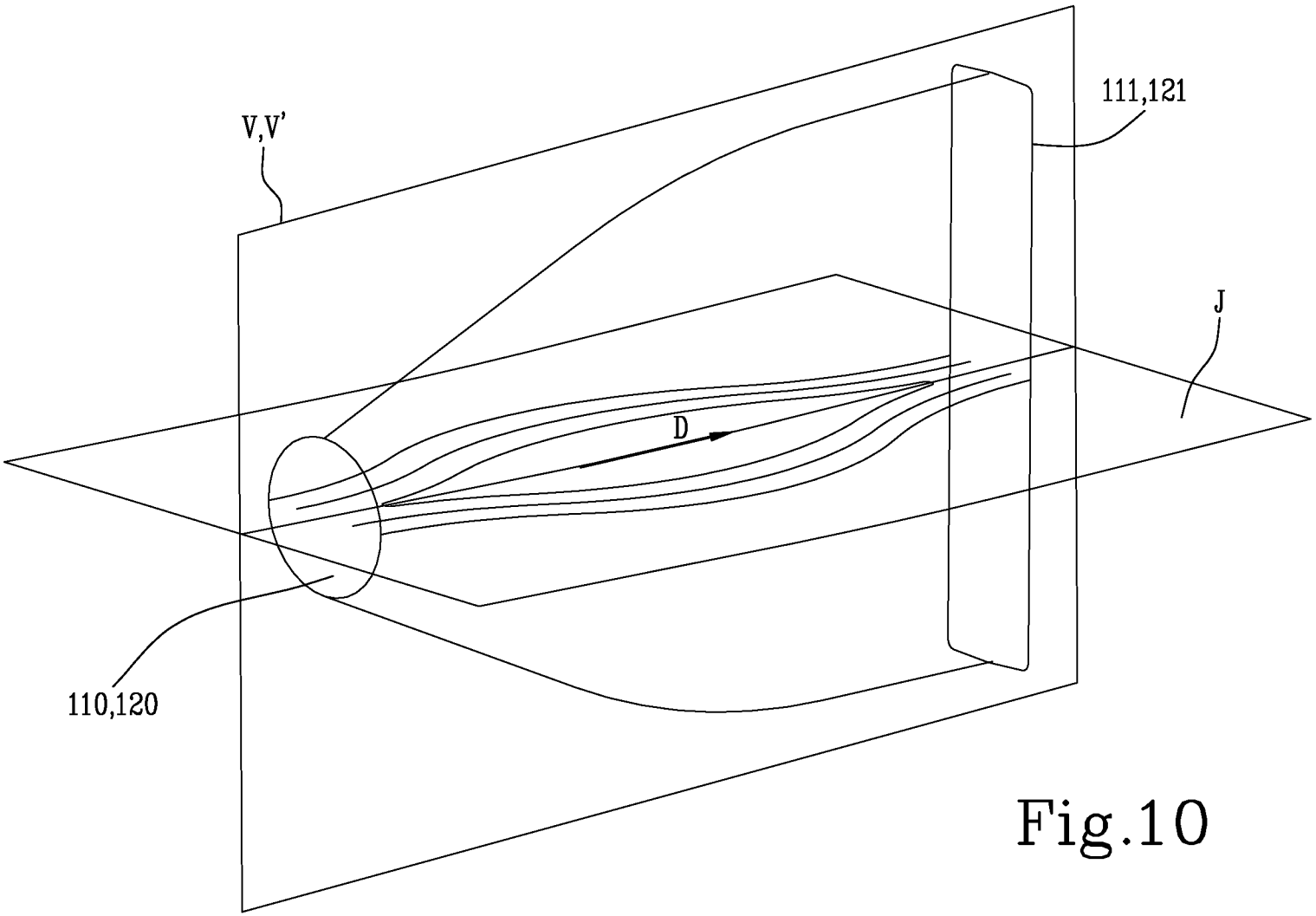
FIG. 10 is a schematic representation of symmetry planes of the waveguide assembly in connection with the shape of said acoustic pathway.
Figure 11:
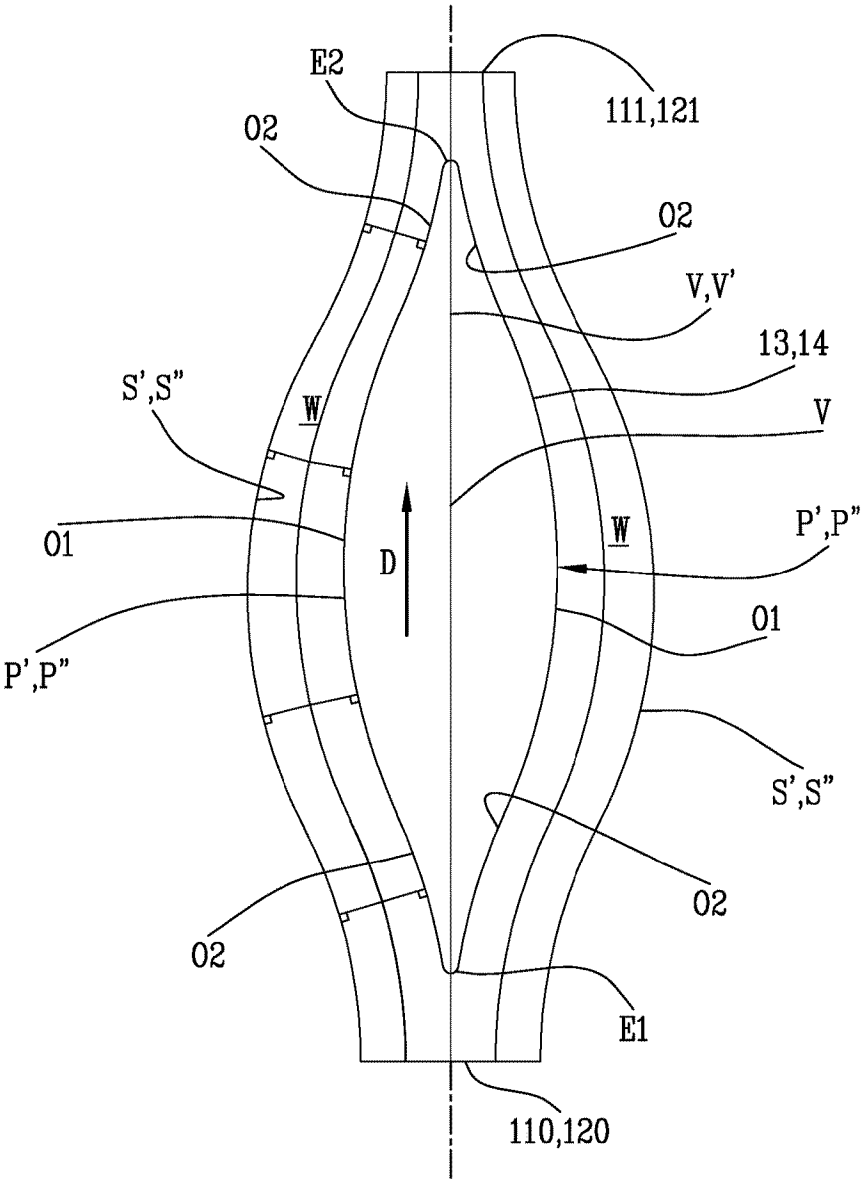
FIG. 11 is a schematic representation of the acoustic pathway taken on a horizontal central ideal surface passing through the waveguide assembly.

Furthermore, the shell 11, 12 is preferably, although not necessarily, provided with a central symmetry plane V, which in use is vertical (see FIGS. 10 and 11).

The length of the outlet opening 111, 121 is also in use vertically orientated.

The shell 11, 12 extends predominantly on said ideal central symmetry plane V, or in any case, in use it is vertically oriented.

Inside the shell 11, 12 a phase plug 13, 14 is inserted, defining therebetween a pathway W (see FIG. 11) for the acoustic energy extending from said inlet opening 110, 120 to said outlet opening 111, 121.

Therefore, said acoustic pathway W is laterally defined by the internal surface S', 5" of the shell 11, 12 walls and the external surface P', P" of the phase plug 13, 14.

Figure 5:
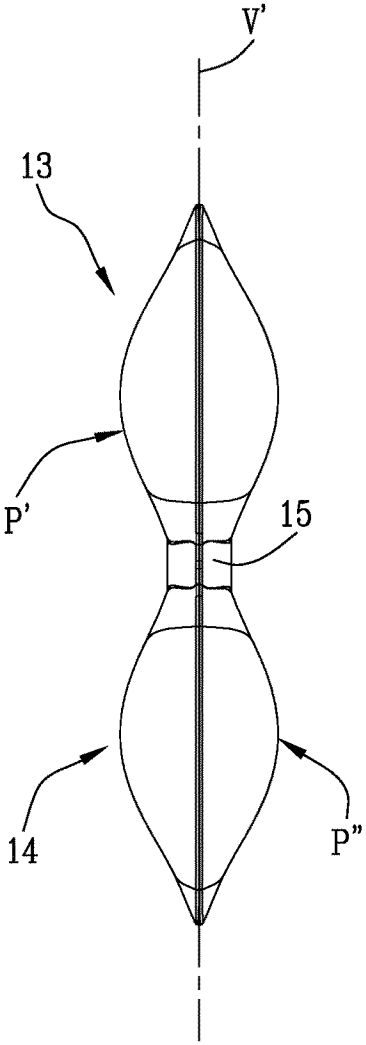

The phase plug 13, 14 of the invention is completely contained in its shell 11, 12 and is preferably, although not necessarily, provided with its own central symmetry plane V', which can be the same one as the shell 11, 12 (see FIGS. 5, 10 and 11).

The phase plug 13, 14 also has a prevalent extension on its symmetry plane V', and it is preferably a solid integral element, representing the core of the waveguide 1 and the only element included in the shell 11, 12.

The pathway W has a longitudinal extension direction D between said openings 110, 120, 111, 121 and one of its important characteristics is that The directions of all longitudinal splines S1, S2, S3, S4, S5, S6 of the pathway W are perpendicular to said inlet opening 110, 120 at said inlet opening 110, 120 on at least one ideal longitudinal surface.

Furthermore, the lengths of all longitudinal splines S1, S2, S3, S4, S5, S6 in the same longitudinal ideal surfaces, equidistant from each other and the top and the bottom internal edges of the shell, are substantially equal from relative points between the inlet opening 110, 120 and the outlet opening 111, 121; in the preferred embodiment shown in the appended drawings, these longitudinal splines are normal to the inlet opening 110, 120, at the outlet opening 111, 121, on at least one ideal longitudinal surface.

Also, the directions of all longitudinal splines S1, S2, S3, S4, S5, S6 of the pathway W can be perpendicular to said outlet opening 111, 121; note that an embodiment of the invention where the directions of all longitudinal splines (S1, S2, S3, S4, S5, S6) of the pathway (W) are transversal to the outlet opening's central axis at said outlet opening (111, 121) is also possible.

Figure 8:
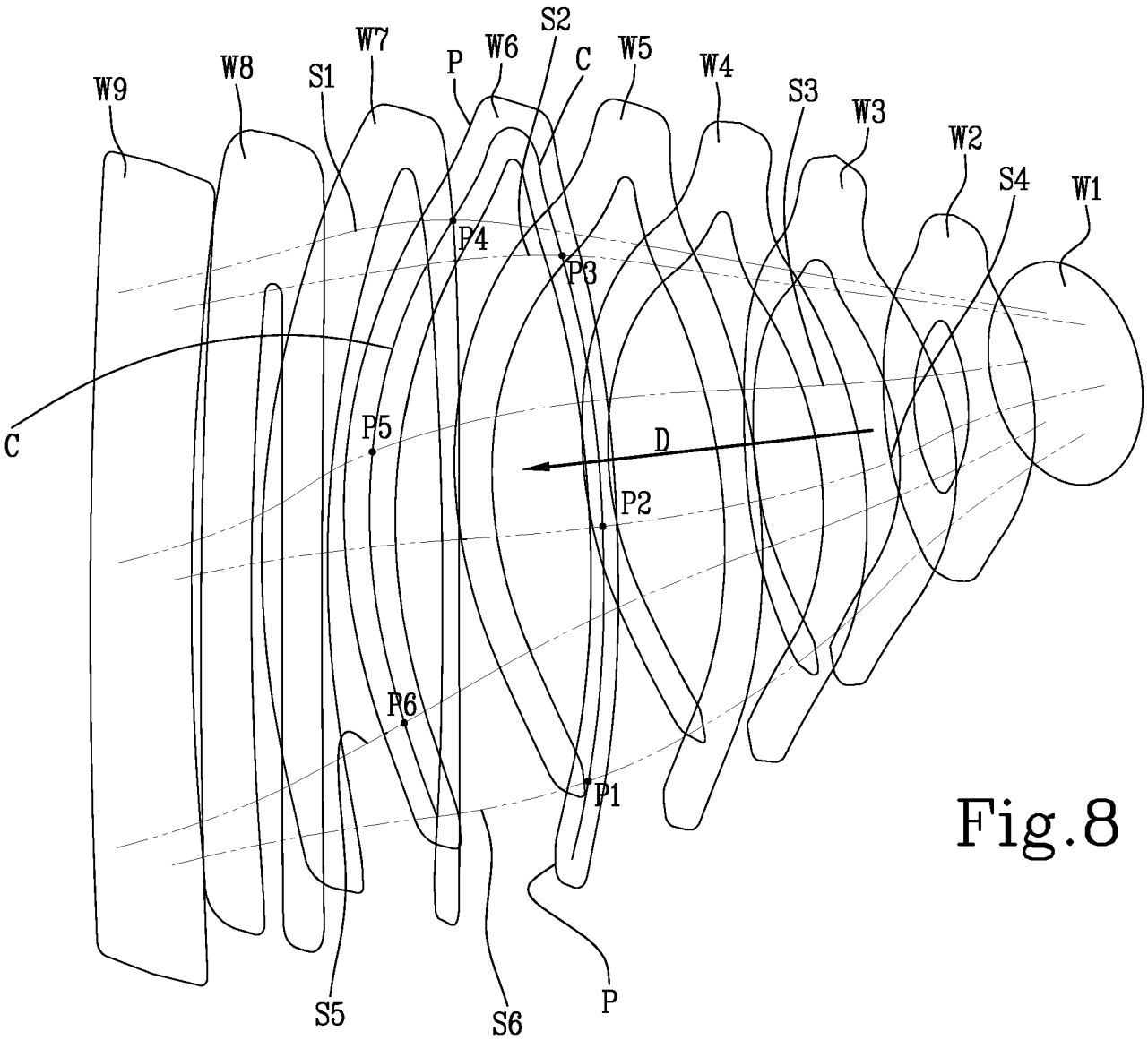
FIG. 8 is a schematic representation of a plurality of transversal cross-sections of an acoustic pathway defined in the waveguide assembly.
Figure 9:
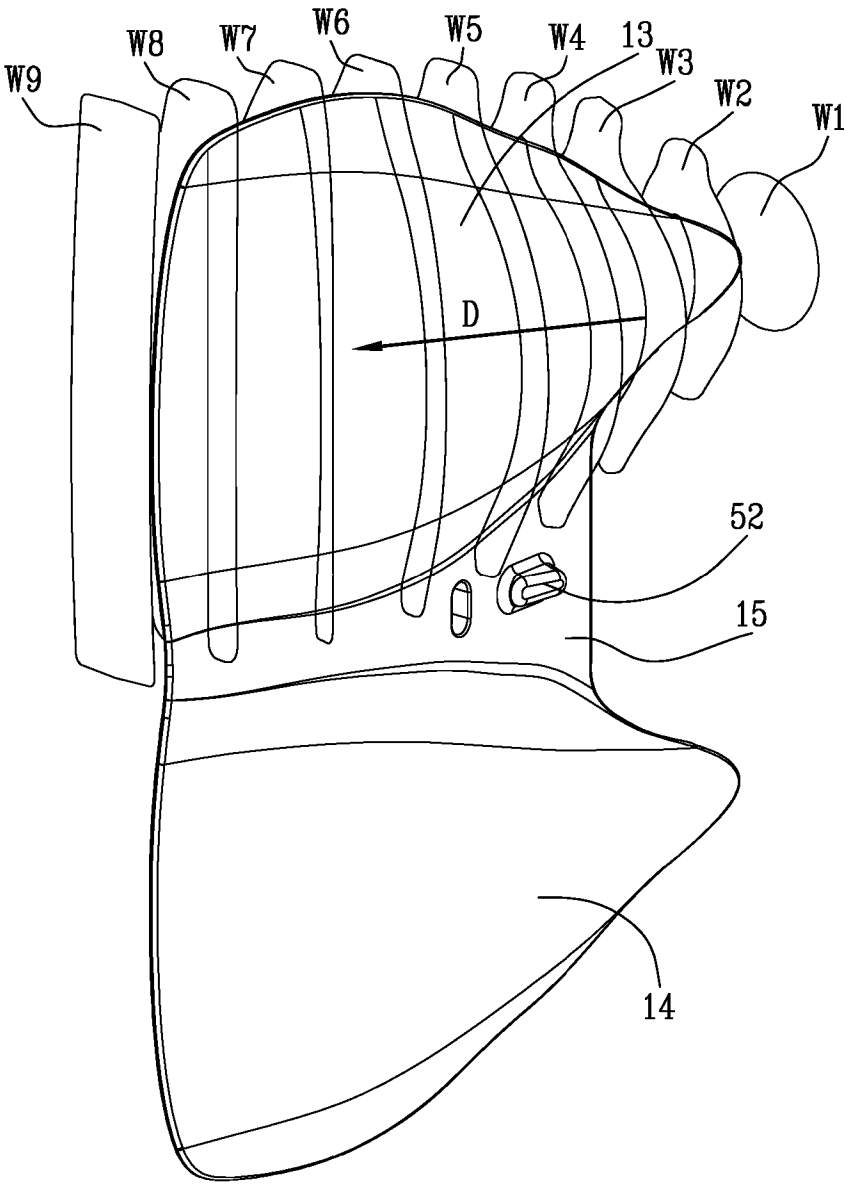
FIG. 9 is a perspective view where the representation of the previous figure is associated with said phase plug element.

According to an important feature of the invention, each transversal cross-section W1, W2, W3, W4, W5, W6, W7, W8, W9 of the pathway W has an ideal centerline C, through which the above-said longitudinal splines S1, S2, S3, S4, S5, S6 pass, which is equidistant from the perimeter P of that transversal cross section (see FIGS. 8 and 9). Note that this feature is exemplificatively shown in FIG. 8 only for the cross-section indicated with W6.

More in detail, a plurality of longitudinal center splines including but not limited to S1, S2, S3, S4, S5, S6 of substantially equal length on horizontal surfaces vertically equidistant from each other and the top/bottom shell edges, defines the three-dimensional center surface, the acoustic pathway W is defined around.

Each of the plurality of groups of relative points P1, P2, P3, P4, P5, P6 along the lengths of all the longitudinal center splines S1, S2, S3, S4, S5, S6 defines each of said centerline C of the acoustic cross-sections; again, this is only exemplificatively shown in FIG. 8 for the cross-section with reference W6.

Note that in the embodiment shown in the figures, the acoustic pathway W has equal curvatures on the above-mentioned longitudinal ideal surfaces (see FIGS. 8, 10 and 11), which in use are horizontal; however, the case of un-equal curvatures on these longitudinal planes is not ruled out.

Furthermore, the acoustic pathway W is such shaped so as to only include tangential transitions along the longitudinal direction from the inlet opening 110, 120 and the outlet opening 111, 121.

Figure 2:
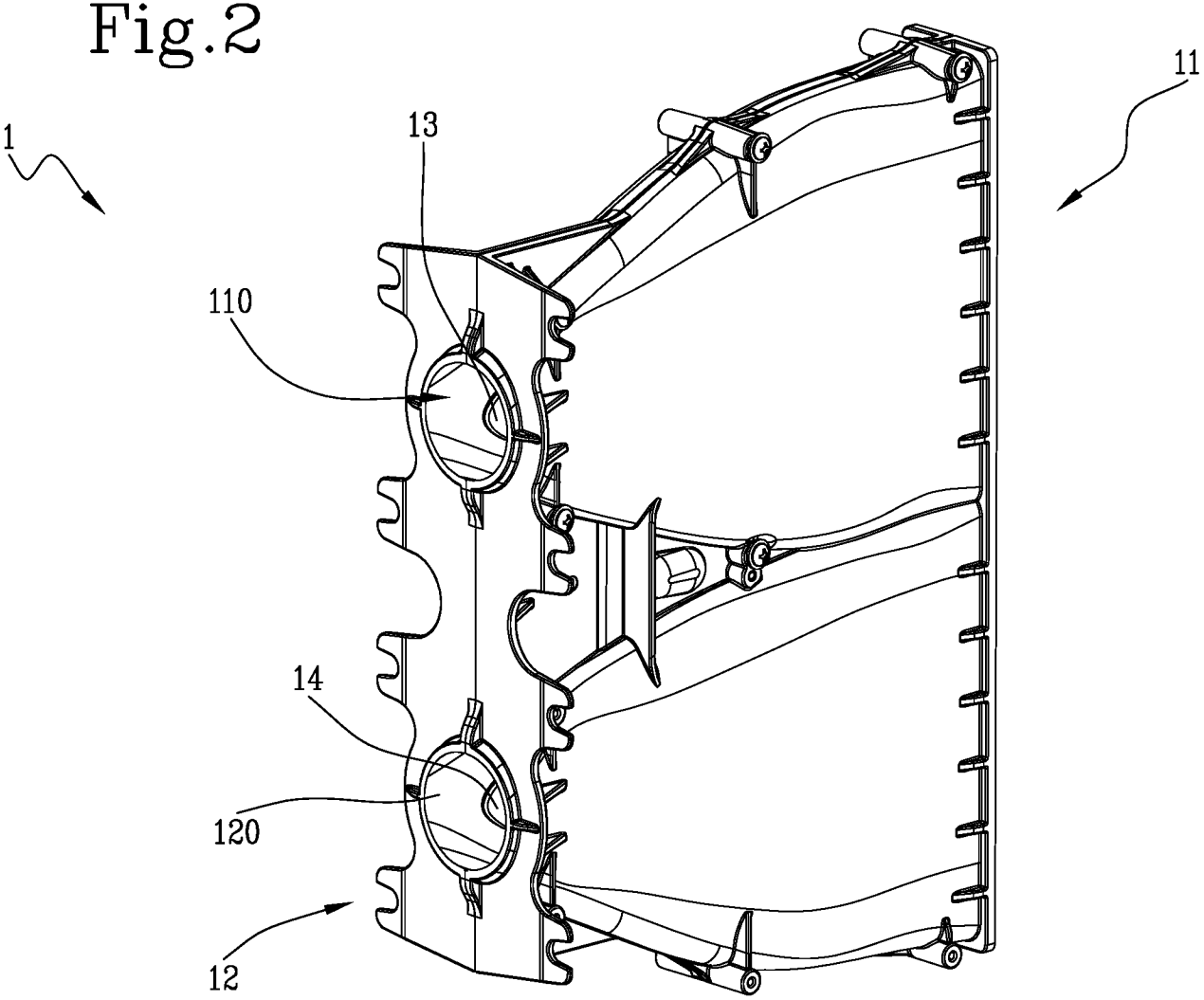
FIG. 2 is a perspective view of the proposed waveguide assembly.
Figure 3:
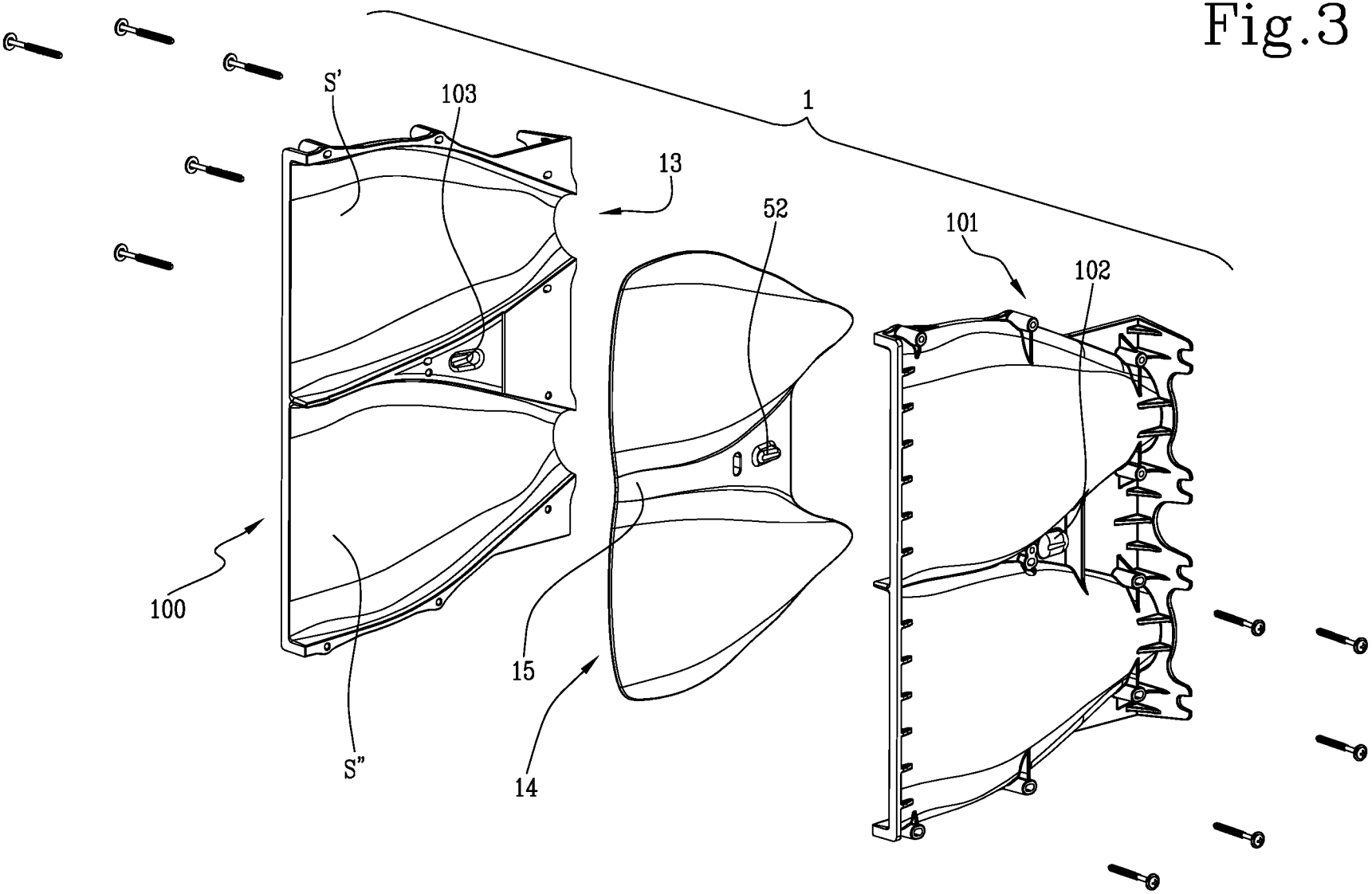
FIG. 3 is an exploded view of the waveguide assembly of the previous figures.
Figure 7:
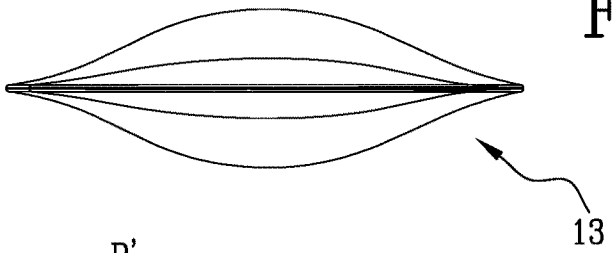
FIGS. 4, 5, 6 and 7 are side elevation, front, back and top views of a phase plug element of the invention.
Figure 6:
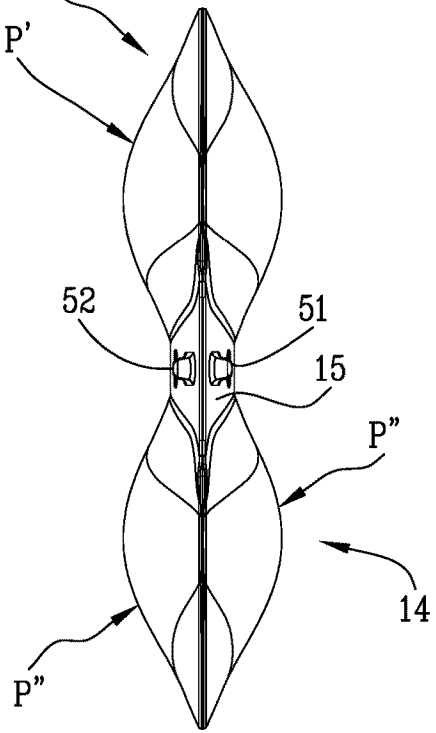
Figure 4:
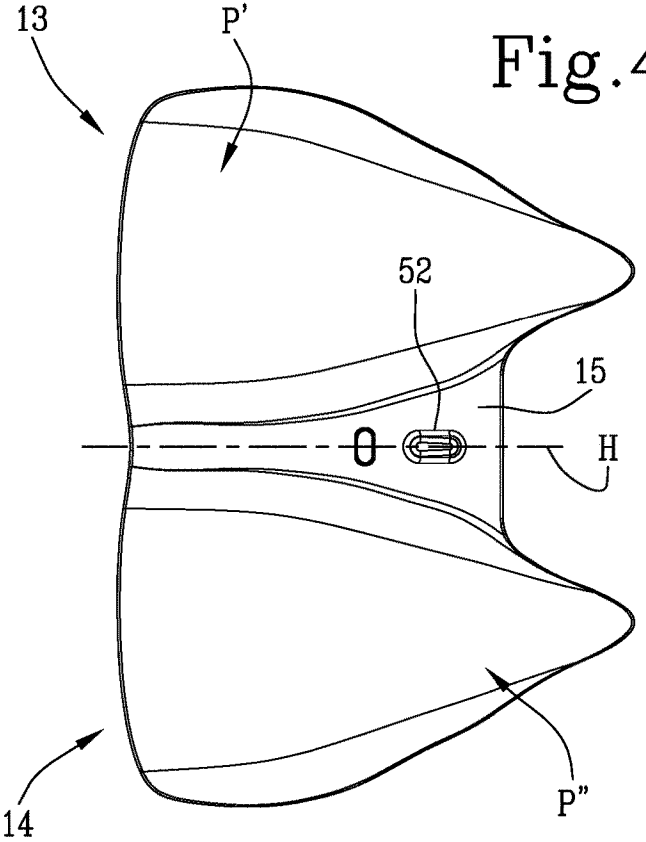

Moreover, as shown in FIGS. 1, 2 and 3, in the preferred embodiment, the waveguide 1 includes a bi-shell assembly, with each single shell 11, 12 being aligned along the common symmetry plane V, V', which in use is vertical; note that the central axes of the inlet and outlet openings 110, 120, 111, 121 can be in this common plane V, V'.

In this construction, the invention comprises an integral phase element 13, 14, 15 shaping a respective phase plug 13, 14 for each shell 11, 12 (see FIGS. 3, 4, 5, 6 and 7); the two phase plugs 13, 14 are identical and symmetric to each other with respect to a median plane H placed between them, which in use is horizontal.

Constructively, as shown in FIG. 3, the shell assembly 11, 12 can be made of two symmetric halves 100, 101 joined at the symmetry plane V, for example by means of removable locking elements, like bolts, or by rivets, etc. . . . .

The phase element 13, 14, 15 can be a solid body member, which shapes the two phase plugs 13, 14, which are joined by means of a common central plate 16 placed at the central symmetry ideal plane V'.

The phase element 13, 14, 15 and the shell assembly 11, 12 are provided with centering means 103, 102, 51, 52, for example the male/female or plug/socket elements shown in FIG. 3 and/or coupling means like bolts, rivets or the like.

Preferably, the bi-shell assembly 12, 13 has two outlet openings 111, 121 facing diverging directions, meaning that the ideal planes of the openings are not parallel with each other.

Therefore, the lower opening 121 is in use slightly facing downwards and the upper opening 111 is slightly facing upwards; however, a parallel openings construction is also possible.

Outlet openings 111, 121 can have respective central axes, which are angled with each other between 0° and 2°.

In this vertical pair design, the top part or "top waveguide" 11, 13 can be configured to produce an exit propagation of 0° to +5° vertical splay, whilst the "bottom waveguide" 12, 14 can be configured to produce 0° to −5° vertical splay; vertically asymmetric designs are however not ruled out.

Note that in each waveguide of the pair, the outlet opening central axis can be offset outwardly from the inlet openings of about 7.4 mm.

The central axes of the outlet openings can be between 134 and 135 mm vertically apart from each other and more preferably are 134.7 mm apart.

The central axes of the inlet openings have a predetermined offset that can be between 6 and 9 mm or between 7 and 8 mm or can be about 7, 4 mm from the outlet openings.

More in general, multi-shell assemblies, defined by a series of shells aligned along a common symmetry plane, each housing a respective phase plug 13, 14 are also possible.

The shell 11, 12 (or each shell) may include a single pathway W for the acoustic energy, the pathway W being such shaped so as to make the acoustic wavefront entering the inlet opening 110, 120 become an isophasic wavefront exiting the outlet opening 111, 121.

Note that although the waveguide 1 can be designed to produce a flat wavefront at the outlet opening 111, 121, the invention can also be designed to emit a curved acoustic wavefront.

Furthermore, in the embodiment shown in the appended drawings, the areas of the pathway cross-sections W1, W2, W3, W4, W5, W6, W7, W8, W9 increase linearly from the inlet opening 110, 120 to the outlet opening 111, 121; however, exponential or logarithmic area expansion rates are not ruled out.

The phase plug 13, 14 (or each phase plug) is almond-shaped and has two smooth lateral surfaces P', P".

More in detail, as shown in FIGS. 4, 5, 6 and 7, the phase plug 13, 14 has preferably a tri-oval lateral shape, and substantially vesica piscis or lens longitudinal cross-sections; even more preferably, as shown schematically in FIG. 11, the longitudinal cross-sections of the phase plug 13, 14 have convex central outlines O1, at both sides, which extend towards opposite directions into concave outlines O2 which in turn join at curved, substantially semi-circular ends E1, E2; note that the ends E1, E2 can also have a sharp shape.

As shown in FIGS. 8 and 9, the single pathway W (or each single pathways in case of multi-shell configuration) includes at least a central portion W3, W4, W5, W6, W7, W8, having bifurcated cross-sections, meaning that the pathway W has a portion between the two openings 110, 120, 111, 121 of the shell 11, 12 in which the cross-sections includes two branches W3, W4, W5, W6, W7, W8 joined together at respective ends.

More in detail, in the preferred embodiment shown in the drawings, the acoustic pathway W starts with an initial circular cross-section W1 at the inlet opening 110, 120, extends in the longitudinal direction with oval cross-sections, then transitions into a vesica piscis cross-sections, then vesica piscis ring cross-sections W2, wish-bone like cross-sections W3, W4, W5, W6, W7, tuning fork like cross-sections W8 and finally into a rectangle shaped cross-section W9 at the outlet opening 111, 121.

The invention claimed is:

1. A waveguide comprising:

at least a shell having an inlet opening configured to receive acoustic energy and an outlet opening for emitting acoustic energy; and a phase plug located within said shell so as to define therebetween a pathway for the acoustic energy from said inlet opening to said outlet opening;

wherein the acoustic pathway has a longitudinal extension direction between said openings, and wherein directions of all longitudinal splines of the pathway are perpendicular to said inlet opening at said inlet opening on at least one ideal longitudinal surface.

2. The waveguide according to claim 1, wherein lengths of all the longitudinal splines of the pathway on ideal longitudinal surfaces, equidistant from each other and top and bottom internal edges of the shell, being substantially equal from relative points of the inlet opening and the outlet opening.

3. The waveguide according to claim 1, wherein directions of all the longitudinal splines of the pathway are perpendicular to said outlet opening at said outlet opening on at least one ideal longitudinal surface.

4. The waveguide according to claim 1, wherein directions of all the longitudinal splines of the pathway are transversal to an outlet opening's central axis at said outlet opening.

5. The waveguide according to claim 1, wherein each transversal cross-section of the pathway has an ideal center line through which said longitudinal splines pass, which is equidistant from a perimeter of that transversal cross section.

6. The waveguide according to claim 1, comprising a single substantially almond-shaped phase plug.

7. The waveguide according to claim 1, wherein the phase plug has a tri-oval side shape.

8. The according to claim 1, wherein the phase plug has substantially vesica piscis longitudinal cross-sections.

9. The waveguide according to claim 1, wherein the phase plug has longitudinal cross-sections having convex central outlines, which extends towards opposite directions into concave outlines joining at respective opposite ends.

10. The waveguide according to claim 1, wherein the shell has a circular inlet opening.

11. The waveguide according to claim 1, wherein the shell has a rectangular outlet opening.

12. The waveguide according to claim 1, including a multiple shell assembly defined by a series of shells aligned along a common symmetry plane, and an internal phase element shaping a respective phase plug for each shell, thereby defining a plurality of acoustic pathways.

13. The according to claim 9, having a bi-shell assembly, the respective outlet openings facing diverging directions.

14. The waveguide according to claim 10, wherein the outlet openings have respective central axes, which are angled with respect to each other between 0° and 2°.

15. The waveguide according to claim 1, wherein the acoustic pathway is shaped so as to make an acoustic wavefront entering the inlet opening become an isophasic wavefront exiting the outlet opening.

16. The waveguide according to claim 1, wherein the pathway is shaped so as to produce a flat acoustic wavefront at the outlet opening.

17. The according to claim 1, wherein the pathway is shaped so as to produce a curved acoustic wavefront at the outlet opening.

18. The waveguide according to claim 1, wherein areas of the pathway cross-sections increase from the inlet opening to the output opening.

19. The waveguide according to claim 1, wherein the areas of the pathway cross-sections increase linearly from the inlet opening to the output opening.

20. The waveguide according to claim 1, wherein areas of the pathway cross-sections increase exponentially from the inlet opening to the outlet opening.

21. The waveguide according to claim 1, wherein areas of the pathway cross-sections increase logarithmically from the inlet opening to the outlet opening.

22. The waveguide according to claim 1, wherein the acoustic pathway has equal curvatures on said longitudinal planes.

23. The waveguide according to claim 1, wherein the acoustic pathway has un-equal curvatures on said longitudinal planes.

24. The waveguide according to claim 1, wherein the acoustic pathway only includes tangential transitions along the longitudinal direction from the inlet opening and the outlet opening.

25. A loudspeaker including the waveguide according to claim 1.

26. A loudspeaker including a plurality of the waveguides according to claim 1.

27. A loudspeaker array including a plurality of the waveguides according to claim 1.

* * * * *